US006352183B1

(12) United States Patent
Kristiansen et al.

(10) Patent No.: US 6,352,183 B1
(45) Date of Patent: Mar. 5, 2002

(54) BOTTLED WATER DELIVERY SYSTEM

(75) Inventors: Keith Kristiansen, Stratford, CT (US); Edward H. Meisner, Riva, MD (US)

(73) Assignee: Great Spring Waters of America, Inc., Greenwich, CT (US)

( * ) Notice: Subject to any disclaimer, the term of this patent is extended or adjusted under 35 U.S.C. 154(b) by 0 days.

(21) Appl. No.: 09/574,415

(22) Filed: May 19, 2000

(51) Int. Cl.[7] ..... B65D 88/54

(52) U.S. Cl. ..... 222/325; 222/88; 141/363; 141/364

(58) Field of Search ..... 222/325, 400.7, 222/55, 113, 183, 88; 141/363, 364, 351

(56) References Cited

U.S. PATENT DOCUMENTS 3,967,638 A * 7/1976 Tondreau ..... 137/216
4,036,406 A * 7/1977 Jespersen et al. ..... 222/181
4,635,673 A * 1/1987 Gerdes ..... 137/216
4,921,135 A * 5/1990 Pleet ..... 222/82
5,351,859 A * 10/1994 Jasen ..... 222/400.7
5,558,256 A * 9/1996 Miller et al. ..... 222/189.09
5,638,991 A * 6/1997 Todden et al. ..... 222/325
5,647,416 A * 7/1997 Desrosiers et al. ..... 141/351
5,947,339 A * 9/1999 Boshears et al. ..... 222/325
6,068,162 A * 5/2000 De Winter et al. ..... 222/325
6,167,921 B1 1/2001 Busick et al.

* cited by examiner

*Primary Examiner*—Timothy L. Maust
*Assistant Examiner*—Khoa Huynh
(74) *Attorney, Agent, or Firm*—Kramer, Levin, Naftalis & Frankel, LLP

(57) ABSTRACT

An undersink water delivery system that includes a housing for holding a container of water and a pump for delivering water to an air gap type faucet. The housing includes a pivotally mounted access door that assists a user in loading a container of water. The access door includes a water delivery coupling that is connected to the pump to deliver water from the container to the faucet. To load a container of water the access door is pivoted to the open position and a container of water is slid into a cradle formed in the access door until the neck of the bottle engages the water delivery coupling. The access door is pivoted upwardly (including the container of water) into the closed position. The access door thereby functions as a lever assisting a user in loading a container of water into the housing.

20 Claims, 6 Drawing Sheets

BOTTLED WATER DELIVERY SYSTEM

FIELD OF THE INVENTION

The present invention is directed to a bottled water delivery system and, more particularly, to a bottled water delivery system having a housing that is adapted to assist in loading a full container of water and that houses a pump that can be connected to a faucet or spigot for drawing water from the container of water.

BACKGROUND OF THE INVENTION

Known in the prior art are stand alone bottled water dispensers for supporting a container of water in an inverted position. These conventional bottled water dispensers are typically equipped with a spigot or valve for drawing water from the container of water into a cup for drinking. The dispenser typically includes a stand having a reservoir at a top end thereof for receiving the container of water in an inverted position.

A container of water, which is often quite heavy, must be lifted from the ground and mounted in the inverted position to the top of the dispenser such that the neck of the container extends within the reservoir. The water flows from the container under the influence of gravity into the reservoir where it can be dispensed from the spigot. At the same time, air is typically introduced into the reservoir or directly into the bottle to vent the system.

As can be imagined, lifting and loading a full container of water requires a significant effort and also often results in water spilling from the container to the ground and surrounding areas. In an effort to address these problem, there are known systems that pump water from an upright container typically situated on the ground to a faucet, spigot or valve for dispensing the water. There are also known containers of water that are provided with a sealing valve in a cap of the container of water that prevents water from spilling while loading the container onto the conventional dispensers. However these known systems do not provide a housing for assisted loading of a container of water. Moreover, a housing is not provided that assists in loading a container of water and also is adapted to receive a container of water having a sealing valve in the cap to prevent water from spilling while loading the container into the housing.

Accordingly, there exists a need in the art for a bottled water delivery system having a housing adapted to assist a user in loading a container of bottled water in an inverted position. There also exists a need for such a housing that mounts a pump and is adapted to receive a container of water without spilling water from the container during loading. There exists a still further need for a bottled water delivery system having a housing with a pivotally mounted access door for assisting in loading a container of water, a coupling for engaging the container of water that prevents spilling during loading and a pump mounted in the housing for delivering water from the container of bottled water to a faucet. Such water delivery system including such housing being preferably mounted under a kitchen sink.

SUMMARY OF THE INVENTION

In accordance with an exemplary embodiment of the present invention, a housing for holding a container of water is provided comprising: a substantially hollow chamber for receiving and substantially enclosing a container of water and an access door pivotally mounted to the housing for moving between an open position and a closed position. The access door comprises an inner wall for supporting the container of water while the bottle is being loaded within the chamber. A coupling is provided for connecting the container of water in an inverted position to a pump for drawing water from the container. The housing preferably can be accommodated under a kitchen sink.

More specifically, a water delivery system for delivering water from a container of water to a faucet is provided, comprising: a container of water having a neck portion and a shoulder portion; a generally hollow housing for receiving and mounting the container of water in an inverted position and an access door pivotally mounted to the housing for moving between an open position and a closed position for loading the container of water within the generally hollow housing such that in the open position the access door provides a support for loading the water bottle within the housing. The housing further includes a coupling mounted to the access door having a center probe and outer sleeve for receiving the neck portion of the container of water and a pump having at least one conduit for drawing water from the container of water to the faucet.

The above and other objects, features and advantages of the present invention will become readily apparent from the following detailed description thereof which is to be read in connection with the accompanying drawings.

DETAILED DESCRIPTION OF THE EXEMPLARY EMBODIMENTS

Figure 1:
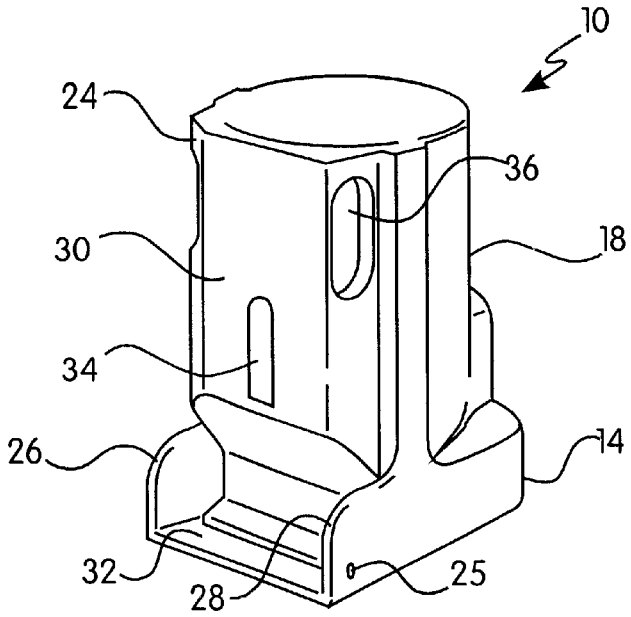
FIG. 1 is a perspective view of a housing according to an exemplary embodiment of the present invention.

With reference to the drawings, and in particular FIGS. 1 through 4, a housing for mounting and enclosing a container of water is illustrated and generally designated as reference numeral 10. As will be detailed hereinafter, the housing 10 is a component in a water delivery system in accordance with an exemplary embodiment of the present invention. The housing 10 includes an enlarged base or pedestal portion 14 for supporting the housing 10 including a container of water. The base portion 14 extends upwardly to an integrally upstanding generally cylindrical casing 18 that defines a similarly shaped internal cavity or chamber 20 for housing a container of water (i.e. a bottle of water).

Figure 2:
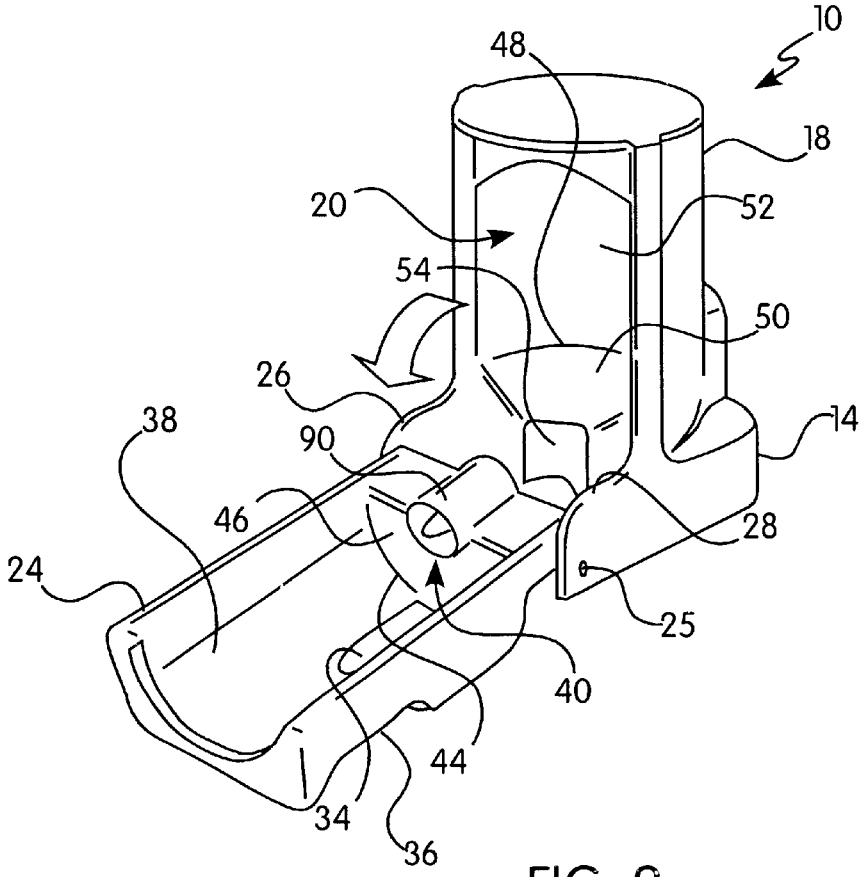
FIG. 2 is a view of the bottled water housing of FIG. 1 with the access door in an open position for loading a container of bottled water.
Figure 3:
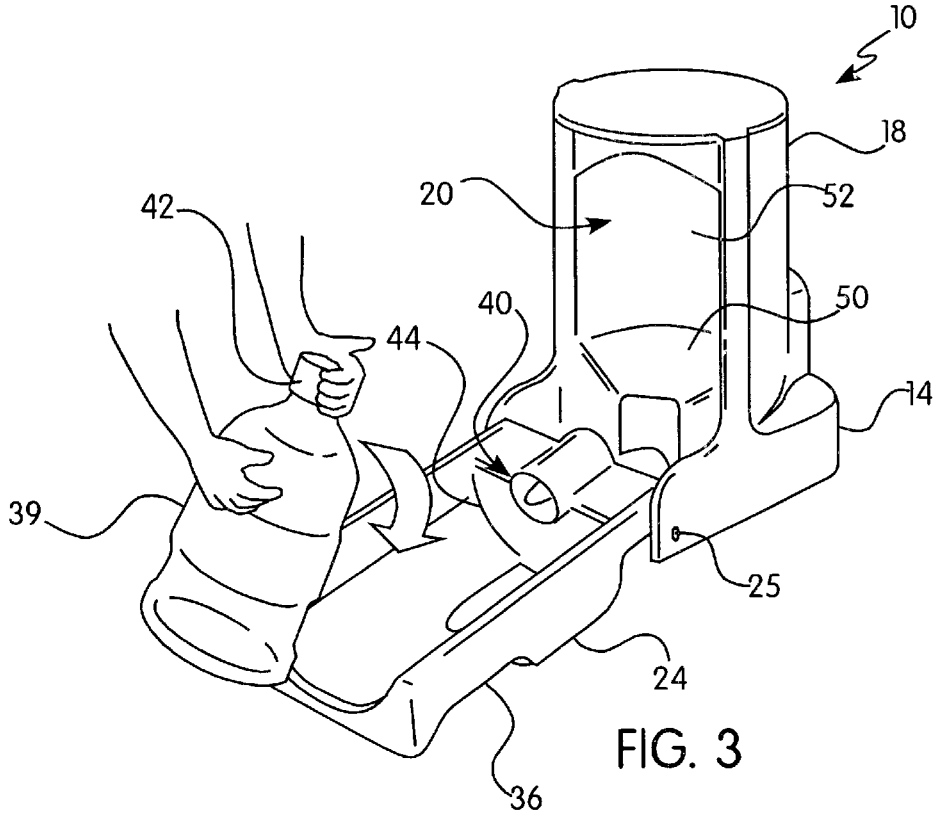
FIG. 3 is a view illustrating;g a first step in loading a container of bottled water within the housing of FIGS. 1 and 2.
Figure 4:
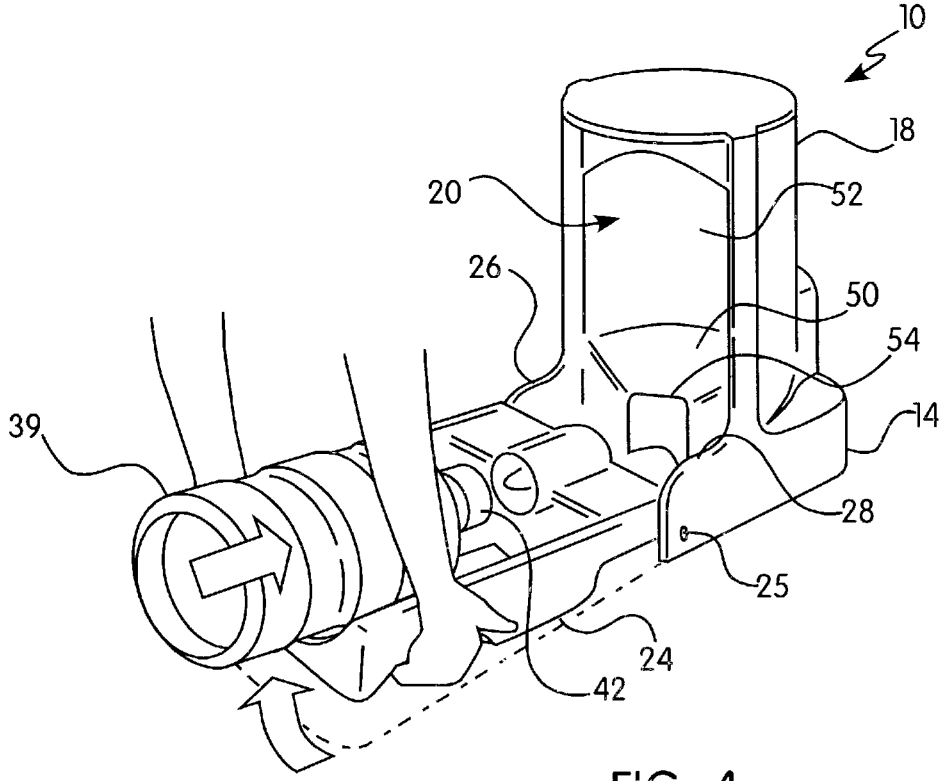
FIG. 4 is a view illustrating a first step in loading a container of bottled water within the housing of FIGS. 1 and 2.

As depicted in FIG. 2, the housing 10 includes an access door 24 that is pivotally mounted along pivot axis 25 between a pair of side walls 26, 28 that extend front the base portion 14. The access door 24 is pivotally mounted on one side (i.e., a front side) of the housing 10 and swings between a closed or an upright position and an open or a down position. The exterior wall 30 of the access door 24 preferably includes integral hand recesses or grips 36 for easier opening and closing of the access door, as shown in FIGS. 3 and 4. The access door 24 preferably also comprises a viewing window 34 for checking the water level in the container of water while the access door 24 is in the closed position. The chamber 20 may include a light source (see FIG. 9) for illuminating the chamber 20 to assist in viewing the water level in the container (even at night).

Referring now to FIGS. 2 and 3, the interior wall 38 of the access door 24 is generally concave shaped and forms a cradle that supports a generally cylindrical container of water. More specifically, as shown in FIGS. 3 and 4, when loading a container of water 39 into the housing 10, the container is placed within the access door 24 and then slid into engagement with a water delivery coupling, generally designated as reference numeral 40. The coupling 40, as will be described hereinafter in detail, engages the neck portion 42 of the container of water 39 and functions to transfer water from the interior of the container to an external faucet, spigot or tap while allowing air to be introduced into the container.

As depicted in FIGS. 2 and 3, the coupling 40 is surrounded by a support shoulder 44 that includes a sloping wall 46 that extends along the interior concave wall 38 of the access door 24. A complementary support shoulder 48 including sloping wall 50 extends within the chamber 20 along a lower portion of the interior wall 52 of the casing 18. The corresponding support shoulder 48 includes a generally cylindrical groove or recess 54 that receives the coupling 40 when the access door 24 is closed. When the access door 24 is in the closed position, the support shoulder 44 and complimentary shoulder 48 form a generally circular shoulder (with the coupling 40 at the center) that supports the container of water in an inverted position.

Figure 5:
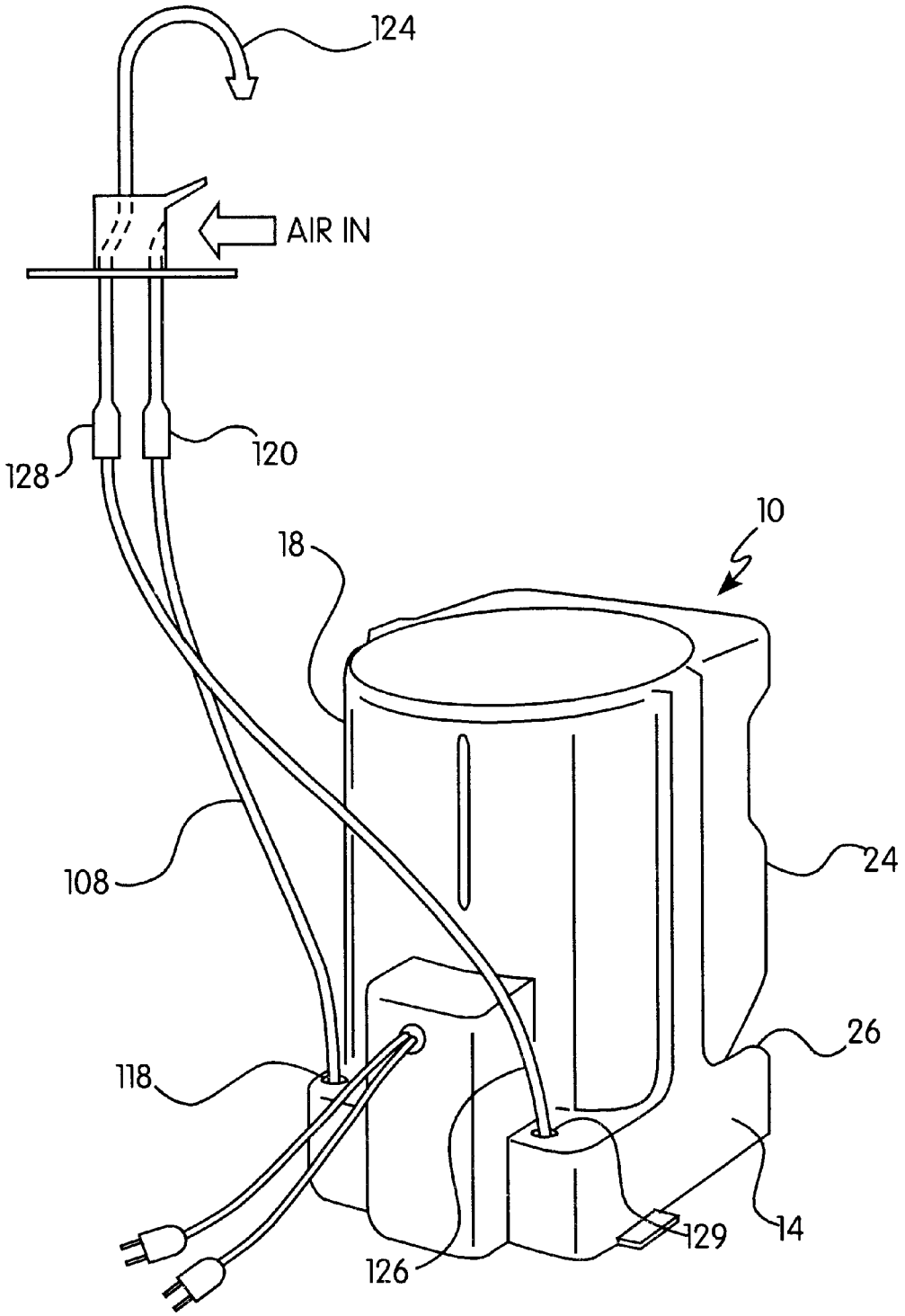
FIG. 5 is a rear view of the bottled water housing configured as part of a water delivery system according to an exemplary embodiment of the present invention.
Figure 6:
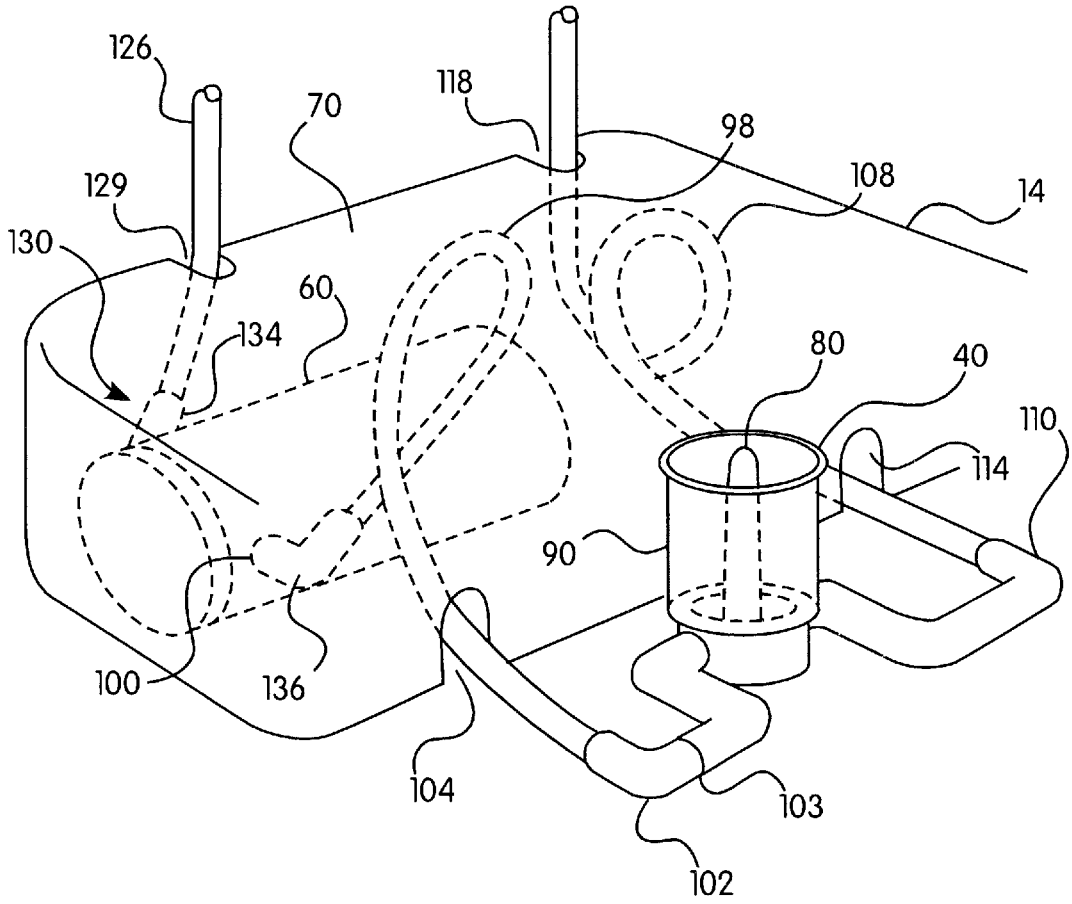
FIG. 6 is a partial view of a lower chamber of the housing of FIG. 5 and various components of the water delivery system according to an exemplary embodiment of the present invention.

In an exemplary embodiment of the present invention, the housing 10 is incorporated in a water delivery system or apparatus comprising a pump and a plurality of conduits for delivering water from the container to a faucet for dispensing, as best depicted in FIGS. 5 and 6. Although not shown in the drawings, the housing 10 of the present invention may also be connected to an ice-maker intake line of a refrigerator or to a faucet or spigot of a refrigerator to the extent one is provided. Referring now to FIGS. 5 and 6, housing 10 preferably includes a secondary chamber for housing an electric pump for drawing water from the container, through the coupling 40. The electric pump may be a demand type electric pump manufactured by Aquatic Water Systems or comparable pump. As depicted in FIG. 5, the demand type pump 60 is housed in lower chamber 70 formed in the back end of the base portion 14. The pump 60 is connected to the coupling 40 for drawing water from the container.

Figure 7:
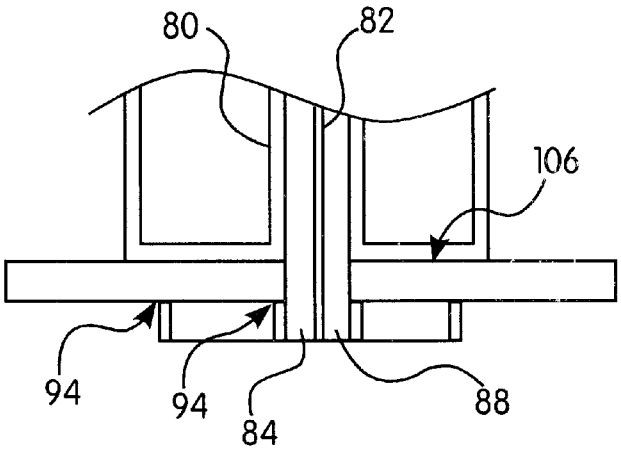
FIG. 7 is a cross sectional view of the coupling shown in water delivery system of FIG. 6.
Figure 8:
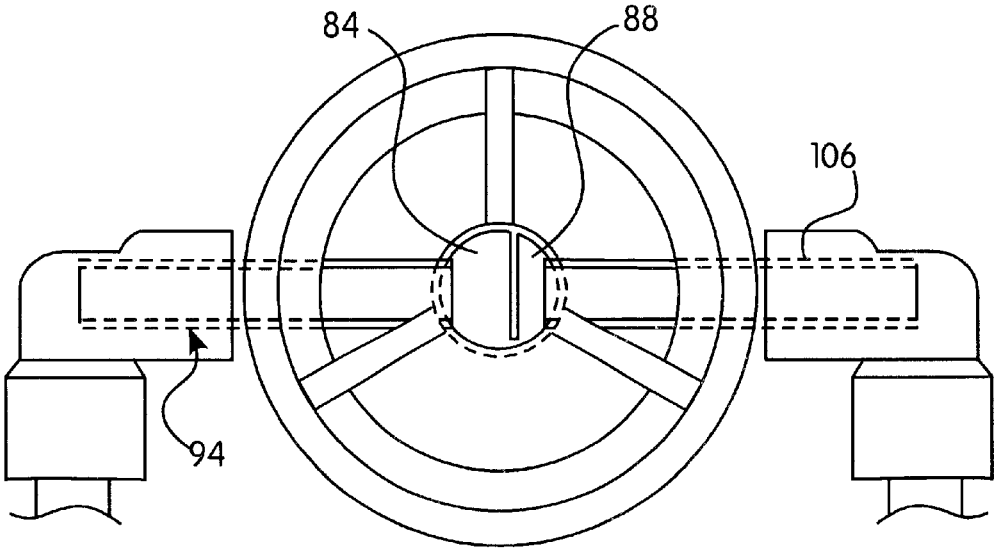
FIG. 8 is a bottom view of the coupling of FIGS. 6 and 7, including a pair of fittings.

More particularly, referring to FIGS. 6 through 8, the coupling 40 includes an actuator probe 80 having dual flow paths formed therein. The interior of the probe 80 is divided by a partition 82 to form first and second parallel paths or channels 84, 88. The first channel 84 is connected to the demand type pump 60 and carries water out of the container for dispensing at a faucet. The second channel 88 is connected directly to the faucet and carries ambient air into the container as water is drawn out through the first channel 84. The actuator probe 84 sits within the center of a collar or upstanding cylindrical wall 90 that receives the neck portion of a conventional container of water, as depicted in FIG. 4.

As detailed in FIGS. 7 and 8, the bottom end of the actuator probe 80 includes a first stub conduit or duct 94 in communication with the interior of the first channel 84 (i.e., the water out side of the actuator probe 80). The stub duct 94 is preferably comolded or bonded to the actuator probe 80. Referring now additionally to FIG. 6, a first hose or tube 98 connects the stub duct 94 to an input side 100 of the demand pump 60. The tube 98, which is connected to the stub duct 94 by a fitting 102, extends through a channel 104 into chamber 70. The fitting 102 is preferably adapted to swivel along a center point 103 to minimize torsional forces that can be created between the fitting 102 and duct 94 as a result of housing the tube 98 within the somewhat confined area of the lower chamber 70.

Similarly, a second stub conduit or duct 106 extends from the opposite side of the actuator probe 80 and is in communication with the second channel 88 (i.e., the air in side of the actuator probe 80). A second hose or tube 108 is connected to the duct 106 by a similar fitting 110. Preferably, the fitting 110 (like fitting 102) is adapted to swivel along a center point to minimize torsional forces created between the fitting 110 and second duct 106.

Referring now to FIGS. 5 and 6, the second hose 108 extends from the second duct 104 through a channel 114 into chamber 70 and out through an opening 118 in the rear of housing 10 to an "air-in" port 120 on faucet 124. Faucet 124 is preferably an air gap (reverse osmosis) type faucet of the type manufactured by Touch-Flo, Inc. A third hose or tube 126 extends from a "water-out" port 128 on the air gap type faucet 124 through an opening 129 in housing 10 to an output side 130 of the demand pump 60. The third hose 126 is preferably mounted to the pump 60 by a plug in elbow type fitting 134 and to the faucet 124 with a similar type fitting. The first hose 98 is connected to an input side of the demand pump 60 by a similar plug in elbow type fitting 136. The first, second and third hoses 98, 108 and 126 are preferably comprised of a ⅜ inch outer diameter, polyethylene tubing.

According to an exemplary embodiment of the present invention, the container of water 39 is loaded onto the access door 24 and slid into engagement with the coupling 40, as shown in FIGS. 3 and 4. The neck portion 42 is fitted within collar 90 while actuator probe 80 cooperates with a displaceable valve member (not shown) in the cap of the container of water. Containers of water having such a displaceable valve member are well known in the prior art. The valve member of the container of water 39 is normally in a closed position for sealing off the container. As the actuator probe 80 is inserted into an opening provided in the cap, the actuator probe 80 upwardly displaces the valve member from its normally closed position. As a result, water can flow from the container through the first channel 84 (or water out side of the actuator probe), while a separate flow of air can be simultaneously introduced into the container of water through the second channel 88 (or the air in side of the actuator probe).

In operation, when a valve (not shown) on the air gap faucet 124 is opened to draw water, water flows from the container of water 39 to the faucet 124 under the action of the pump 60. As is known, in response to pressure changes at the output side 130 of the pump 60, the demand pump 60 will turn on and turn off as necessary to draw water from the container of water 39. At substantially the same time, the air gap faucet introduces outside or ambient air into the container of water through the second hose 108 and duct 106. The outside air is fed into the container of water through channel 88 of probe 80. In this manner, the container of water can be vented using air from outside the kitchen cabinet where the housing 10 is typically contained. Thus when the container of water 39 is fully installed onto the coupling 40 within the housing 10 downward water flow commences through channel 84 of the actuator probe 80 through duct 84, hose 98, demand pump 60 and hose 126 to faucet 124. Almost simultaneously, air is introduced through the faucet 124 into the container of water to replace the dispensed volume of water.

Figure 9:
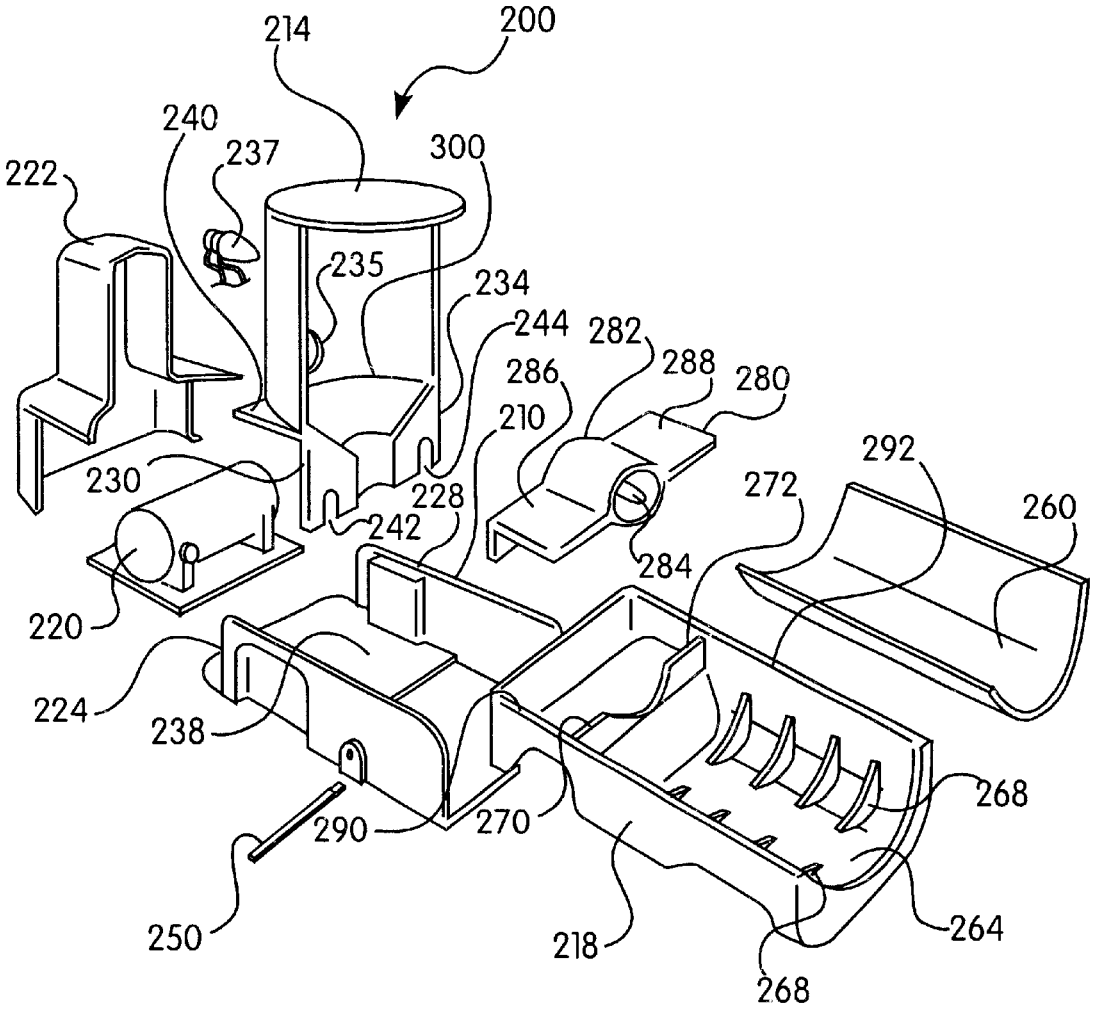
FIG. 9 is an exploded view of an alternative exemplary embodiment of the present invention.

In an alternative exemplary embodiment of the present invention, the housing may have a modular construction, as shown in FIG. 9. The housing, generally designated as reference numeral 200, may comprise a housing base 210, a top enclosure 214, an access door 218, a demand pump 220 secured to the housing base 210, and a rear cover 222 for enclosing the demand pump 220. These various modular components of the housing 200 may be secured to each other using conventional means such as press or snap fitting, welding, adhesives or screws, rivet and other fastening means.

More particularly, the top enclosure 214 is mounted between side walls 224, 228 of base 210. The top enclosure 214 is supported with supports 230, 234 that elevate the top enclosure 214 above the bottom wall 238 of the base 210. The top enclosure 214 includes a rear panel 240 that extends substantially perpendicular from the top enclosure 214 and cooperates with rear cover 222 to form a chamber that houses the demand pump 220. The top enclosure also includes opening 235 through which light source 237 may pass to illuminate the interior of enclosure 214.

The pump 220 is seated on the bottom wall 238 of base 210 behind supports 230, 234 and at least partly under rear panel 240. The rear cover 222 is mounted to the base 210 and extends over the pump 220. Together the housing base 210, rear cover 222 and rear panel 240 form an enclosure that houses the pump 220 within a rear, lower portion of the housing 200. As is also shown in FIG. 9, the supports 230, 234 include channels 242, 244 that permit hoses (as shown in FIG. 6) to extend into the chamber that houses the pump 220.

The access door 218 is pivotally mounted to the base 210 using a pivot pin 250 and includes a concave door liner 260 that sits partly over an inner wall 264 of the access door 218. The inner wall 264 includes a plurality of reinforcing ribs 268 that provide support for the concave door liner 260. As with the first exemplary embodiment, the access door 218 and more particularly liner 260 forms a cradle that receives a conventionally shaped container of water for assisting in the loading the container into the top enclosure 214.

As further shown in FIG. 9, at one end the liner 260 abuts a ledge 270 having a groove 272. The ledge 270 and groove 272 cooperate with a coupling assembly 280 having an outer cylindrical wall 282 that surrounds actuator probe 284 and wings 286, 288 that extend in opposite directions from cylindrical wall 282. The coupling assembly 280 is press fit between walls 290, 292 of access door 218 and the cylindrical wall 282 is received within groove 272. The coupling assembly 280 may be secured in this position by adhesive, welding or other known means. When the access door 218 including the coupling assembly 280 is closed, the ledge 270 cooperates with support shoulder 300 in enclosure 214 and together with coupling assembly 280 support the container of water in an inverted position. The details of the actuator probe 284, the pump operation, the hoses and faucet are not shown or discussed as they are identical to what has been described with respect to the first exemplary embodiment.

Having described exemplary embodiments of the present invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A housing for holding a beverage container comprising:

a substantially hollow chamber for receiving a beverage container;

an access door pivotally mounted to said housing for moving said access door between an open position and a closed position, said access door having an inner wall for assisting in the loading of said beverage container within said substantially hollow chamber;

a coupling including a probe to engage said beverage container and in a fixed position relative to said access door such that as said access door is moved between said open position and said closed position said probe is received within said beverage container; and a pump connected to said beverage container for drawing water from said beverage container.

2. The housing of claim 1 further comprising a second chamber for holding a pump and at least one conduit for drawing a beverage from said beverage container.

3. The housing of claim 1 wherein said coupling is mounted to said access door.

4. The housing of claim 1 wherein said a probe further comprises first and second parallel channels for drawing a beverage from said beverage container and letting air into said beverage container, respectively.

5. The housing of claim 1 wherein said access door includes a viewing window for checking the level of a beverage in said beverage container while said access door is in said closed position.

6. The housing of claim 5 further comprising a light source for illuminating said chamber receiving said beverage container.

7. The housing of claim 1 further comprising a support shoulder for supporting the beverage container in an inverted position in said substantially hollow chamber.

8. The housing of claim 7 wherein said coupling is in the center of said support shoulder.

9. A water delivery apparatus for delivering water from a container of water to a faucet, comprising:

a container of water having a neck portion and a shoulder portion;

a generally hollow housing for receiving and mounting said container of water in an inverted position;

an access door pivotally mounted to said housing for moving between an open position and a closed position for loading said container of water within said generally hollow housing such that in said open position said access door provides a support for loading said container of water within said housing;

a coupling mounted to said access door having a center probe aid outer sleeve for receiving said neck portion of said container of water, said coupling in a fixed position relative to said access door such that as said access door is moved between said open position and said closed position said probe is received within said container of water; and a pump having at least one hose connected to said coupling for drawing water from said container of water to said faucet.

10. The apparatus of claim 9 wherein said center probe comprises first and second parallel channels for drawing water from said container and letting air into said container, respectively.

11. The apparatus of claim 9 wherein said faucet comprises an air gap type faucet.

12. The housing of claim 9 wherein said access door includes a viewing window for checking the level of water in the container of water while said access door is in said closed position.

13. The housing of claim 12 further comprising a light source for illuminating the interior of said housing.

14. A water delivery apparatus according to claim 9 wherein said pump is mounted within said housing.

15. The water delivery apparatus of claim 9 wherein said pump is a demand pump that is activated when said faucet is opened for drawing water from said container of water.

16. The water delivery apparatus of claim 9 further comprising a venting hose connected between said coupling and said faucet to deliver air into said container of water as water is drawn out.

17. A water delivery apparatus for delivering water from a container of water to a faucet, comprising:

a generally hollow housing for receiving and mounting a container of water in an inverted position;

an access door pivotally mounted to said housing for moving between an open position and a closed position for loading said container of water within said generally hollow housing; said access door defining a cradle for receiving said container of water for assisting in loading said container of water within said housing;

a coupling having a probe in communication with the water in said container of water and in a fixed position relative to said access door such that as said access door is moved between said open position and said closed position said probe is received within said container of water, said probe comprising a first channel for drawing water from said container of water and a second channel for letting air into said container of water; and a pump having at least one conduit for drawing water from said container of water to said faucet.

18. The apparatus of claim 17 further comprising a first conduit coupled to said probe for communicating with said first channel and a second conduit coupled to said probe for communicating with said second channel.

19. The apparatus of claim 18 wherein said second conduit is coupled to a venting port provided on said faucet.

20. The apparatus of claim 17 wherein said faucet comprises an air gap type faucet.

* * * * *